US012564793B2

(12) United States Patent
Kanemura et al.

(10) Patent No.: US 12,564,793 B2
(45) Date of Patent: Mar. 3, 2026

(54) DEFORMABLE TOY

(71) Applicant: BANDAI CO., LTD., Tokyo (JP)

(72) Inventors: Tadanori Kanemura, Tokyo (JP); Kanako Ikeda, Tokyo (JP)

(73) Assignee: BANDAI CO., LTD., Tokyo (JP)

( * ) Notice: Subject to any disclaimer, the term of this patent is extended or adjusted under 35 U.S.C. 154(b) by 207 days.

(21) Appl. No.: 18/381,896

(22) Filed: Oct. 19, 2023

(65) Prior Publication Data

US 2024/0408504 A1 Dec. 12, 2024

(30) Foreign Application Priority Data

Jun. 7, 2023 (JP) ..... 2023-094323

(51) Int. Cl.
*A63H 3/18* (2006.01)
*A63H 3/04* (2006.01)

(52) U.S. Cl.
CPC ..... *A63H 3/04* (2013.01); *A63H 3/18* (2013.01)

(58) Field of Classification Search
CPC ..... A63H 3/18; A63H 3/20; A63H 13/16
See application file for complete search history.

(56) References Cited

U.S. PATENT DOCUMENTS 1,291,252 A * 1/1919 Terpening ..... A63H 3/18 446/361
2,764,841 A * 10/1956 Birnbaum ..... A63H 3/18 446/365
4,223,561 A * 9/1980 Guerrero ..... A63H 3/20 74/105
4,682,970 A * 7/1987 Dubois ..... A63H 3/48 446/368
5,651,717 A * 7/1997 Hamilton ..... A63H 3/48 446/362
6,224,456 B1 * 5/2001 Wittenberg ..... A63H 3/46 446/376
6,953,379 B1 * 10/2005 Wang ..... A63H 3/20 446/330
7,611,397 B1 * 11/2009 Lund ..... A63H 31/00 446/311
8,517,791 B2 * 8/2013 Yamada ..... A63H 33/26 446/129

FOREIGN PATENT DOCUMENTS

JP S60-124992 U 8/1985
JP S62-059094 U 4/1987
JP 2014-144211 A 8/2014

OTHER PUBLICATIONS

Oct. 23, 2023, Japanese Office Action issued for related JP Application No. 2023-094323.

* cited by examiner

*Primary Examiner* — John A Ricci
(74) *Attorney, Agent, or Firm* — Paratus Law Group, PLLC

(57) ABSTRACT

A deformable toy deformable from a first form to a second form different from the first form includes: a first component; a second component; a holding mechanism provided in the first component and capable of holding the second component in a first position; and a release mechanism provided in the first component and capable of releasing the second component from the holding mechanism by vibration. The second component released from the holding mechanism by the release mechanism is moved from the first position to a second position different from the first position to deform the deformable toy from the first form to the second form.

15 Claims, 8 Drawing Sheets

DEFORMABLE TOY

CROSS-REFERENCE TO RELATED APPLICATIONS

This application claims priority from Japanese Patent Application No. 2023-094323, filed on Jun. 7, 2023, the entire contents of which is incorporated herein by reference.

TECHNICAL FIELD

The present disclosure relates to a deformable toy that can be deformed from a first form to a second form.

BACKGROUND

In recent years, deformable toys that can be deformed from one form to another have become popular. For example. Japanese Patent Application Laid-open Publication No. 2014-144211 discloses a robot toy that can be deformed from a human shape to a car shape by remote control.

SUMMARY

In the development of deformable toys, toys are required to be easily deformed from one form to another with simpler movements and in a shorter time. Other issues and novel features will become apparent from the description of the description and the accompanying drawings.

An aspect of the present disclosure relates to a deformable toy deformable from a first form to a second form different from the first form includes: a first component; a second component; a holding mechanism provided in the first component and capable of holding the second component in a first position; and a release mechanism provided in the first component and capable of releasing the second component from the holding mechanism by vibration. The second component released from the holding mechanism by the release mechanism is moved from the first position to a second position different from the first position to deform the deformable toy from the first form to the second form.

According to an embodiment, it is possible to provide a deformable toy that can easily deform from one form to another with simpler movements and in a shorter time.

DESCRIPTION OF EMBODIMENTS

Figure 1:
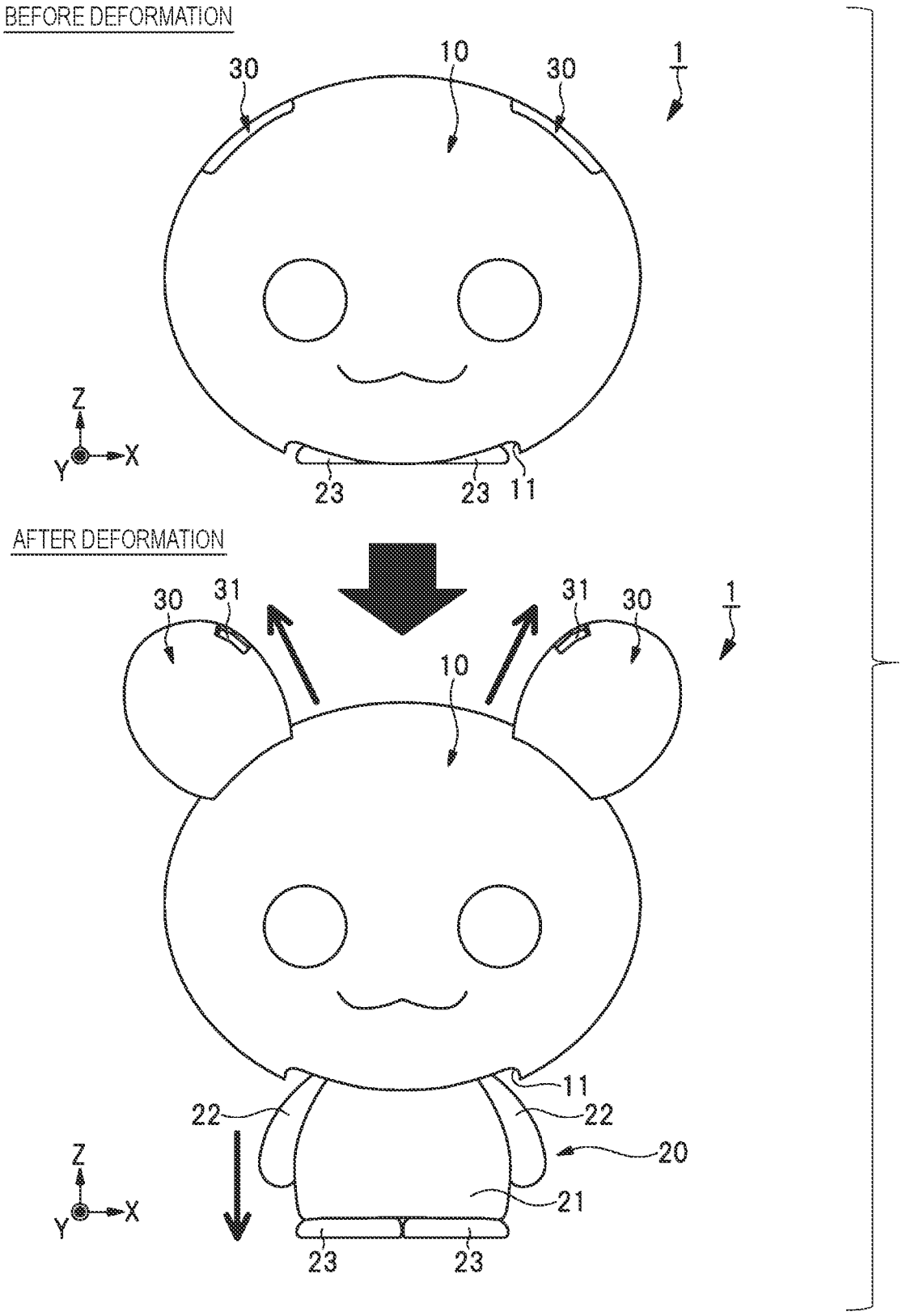
FIG. 1 is a front view illustrating the appearance of a deformable toy according to a first embodiment.

Hereinbelow, embodiments will be described in detail with reference to the drawings. In all the drawings for explaining the embodiments, the members having the same functions are designated by the same reference numerals, and the redundant description thereof will be omitted. In the following embodiments, the description of the same or similar components will not be repeated in principle except when it is particularly necessary. X, Y, and Z directions described herein intersect with each other and are orthogonal to each other.

First Embodiment

A deformable toy 1 in the first embodiment will be described below with reference to FIGS. 1 to 10. The deformable toy 1 is a toy that can be deformed from a first form to a second form different from the first form, such as from a spherical form to a doll form, for example. For example, the deformation is performed by a user picking up the deformable toy 1 and applying vibration to the deformable toy 1, such as by shaking the deformable toy 1. Note that the deformation from the first form to the second form is not limited to the deformation from the spherical form to the doll form, but also includes a deformation from a geometric form to a form representing a figurative object, and the like.

Figure 2:
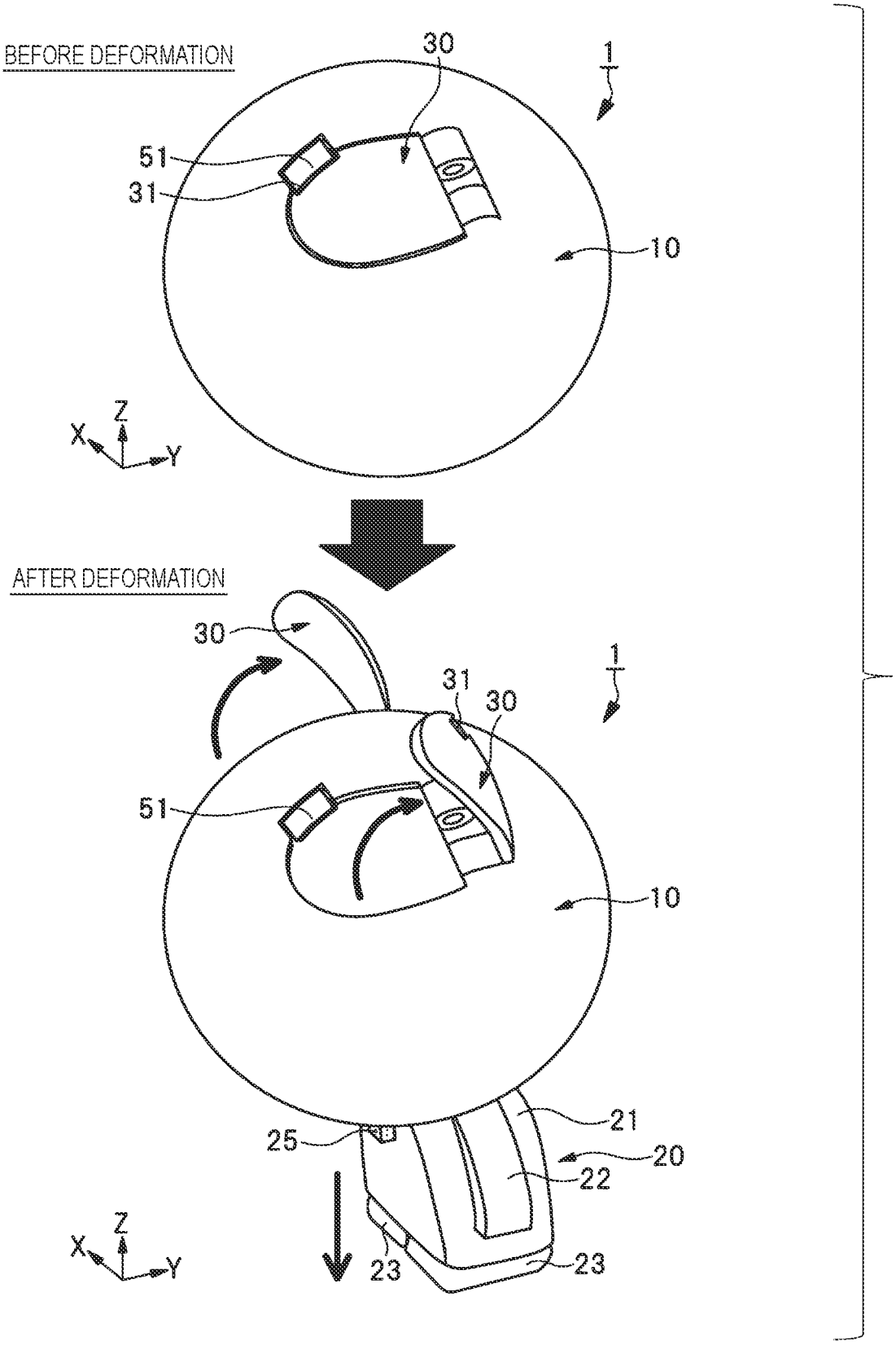
FIG. 2 is a perspective view illustrating the appearance of the deformable toy according to the first embodiment.

FIGS. 1 and 2 illustrate the appearance of the deformable toy 1 before and after deformation by vibration. As illustrated in FIGS. 1 and 2, the deformable toy 1 includes components 10, 20, and 30. The deformation from the spherical form to the doll form is performed by each of the components 20 and 30 moving from a predetermined position to another position different from the predetermined position.

An opening 11 is formed in the component 10 to communicate the inside and outside of the component 10. Before deformation by vibration, the component 20 is positioned inside the component 10 (first position). After deformation by vibration, the component 20 is moved to a position outside the component 10 (second position) via the opening 11. Before the deformation by vibration, the component 30 is positioned to cover a part of an outer peripheral surface of the component 10 (first position, third position. After the deformation by vibration, the component 30 is moved to a position protruding from the component 10 such that a part of the outer peripheral surface of the component 10 is exposed (second position, fourth position).

Note that the deformable toy 1 after the deformation by vibration is in the form of a doll. The component 20 includes a main body 21, a displacement part 22 (third displacement part), and a placement part 23. The displacement part 22 and the placement part 23 are connected to the main body. The component 10 forms a head of the doll. The main body 21 forms a body of the doll. The displacement part 22 forms upper limbs of the doll. The placement part 23 forms lower limbs of the doll. The component 30 forms ears, hair, corner, head ornament of the doll, or the like.

As such, with the deformable toy 1 according to the first embodiment, deformation from a spherical form to a doll shape can be achieved by a simple motion of applying vibration. By performing the deformation in a shorter time, it is possible to obtain a sudden and unexpected effect. The component 10 itself has a substantially spherical form. When the component 20 is held at a position inside the component 10, the placement part 23 is placed at the position of the opening 11 and covers substantially the entire opening 11. Therefore, the beauty of the spherical form before deformation by vibration is not impaired. Note that while it is preferable that substantially the entire component 20 is positioned inside the component 10 before deformation in terms of increasing the unexpectedness of deformation, there is no problem even when a part of the component 20 is positioned outside the component 10 before deformation, because the deformation still gives pleasure. Since the component 10 itself has the substantially spherical form and the component 30 is held along the outer peripheral surface of the component 10, the beauty of the spherical form before deformation by vibration is not impaired.

Figure 3:
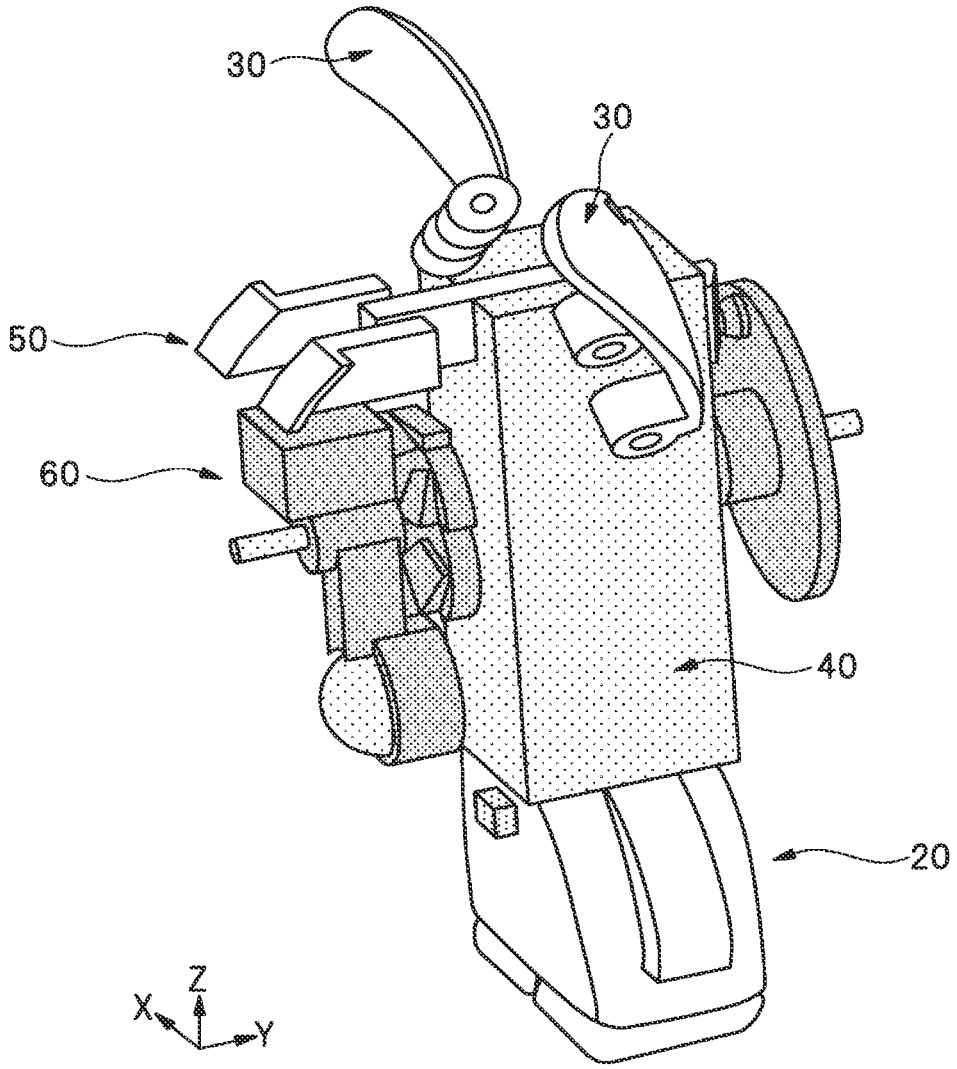
FIG. 3 is a perspective view illustrating the inside of the deformable toy according to the first embodiment.
Figure 4:
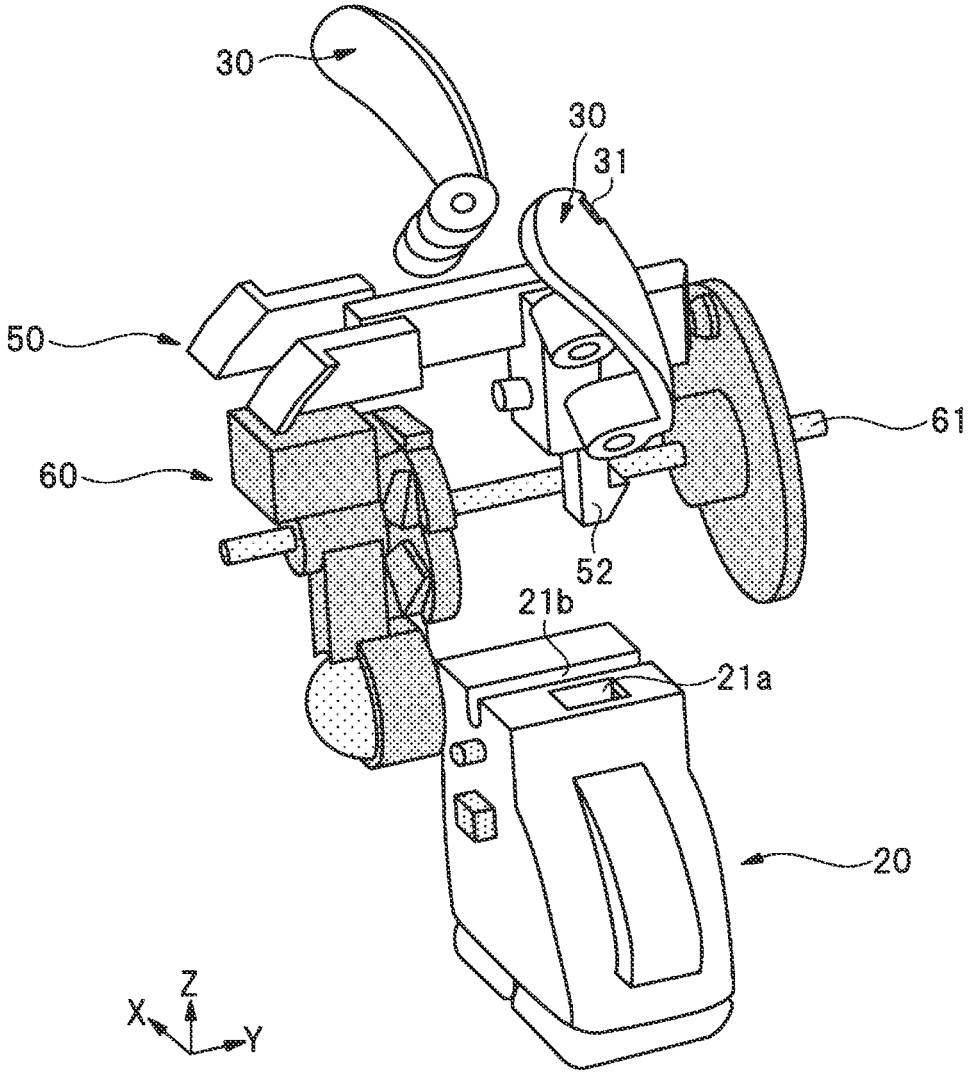
FIG. 4 is a perspective view illustrating the inside of the deformable toy according to the first embodiment.

Hereinafter, the mechanism by which the deformable toy 1 is deformed upon application of vibrations will be described. FIG. 3 illustrates the inside of the component 10 after deformation by vibration, and FIG. 4 illustrates the inside of a storage part 40 after deformation by vibration. As illustrated in FIG. 3, the storage part 40, a holding mechanism 50, and a release mechanism 60 are provided inside the component 10.

When the component 20 is positioned inside the component 10, the component 20 is housed inside the storage part 40. When the component 20 is moved to the outside of the component 10, the component 20 is moved from the inside of the storage part 40 to the outside of the storage part 40 via the opening 11.

Figure 5:
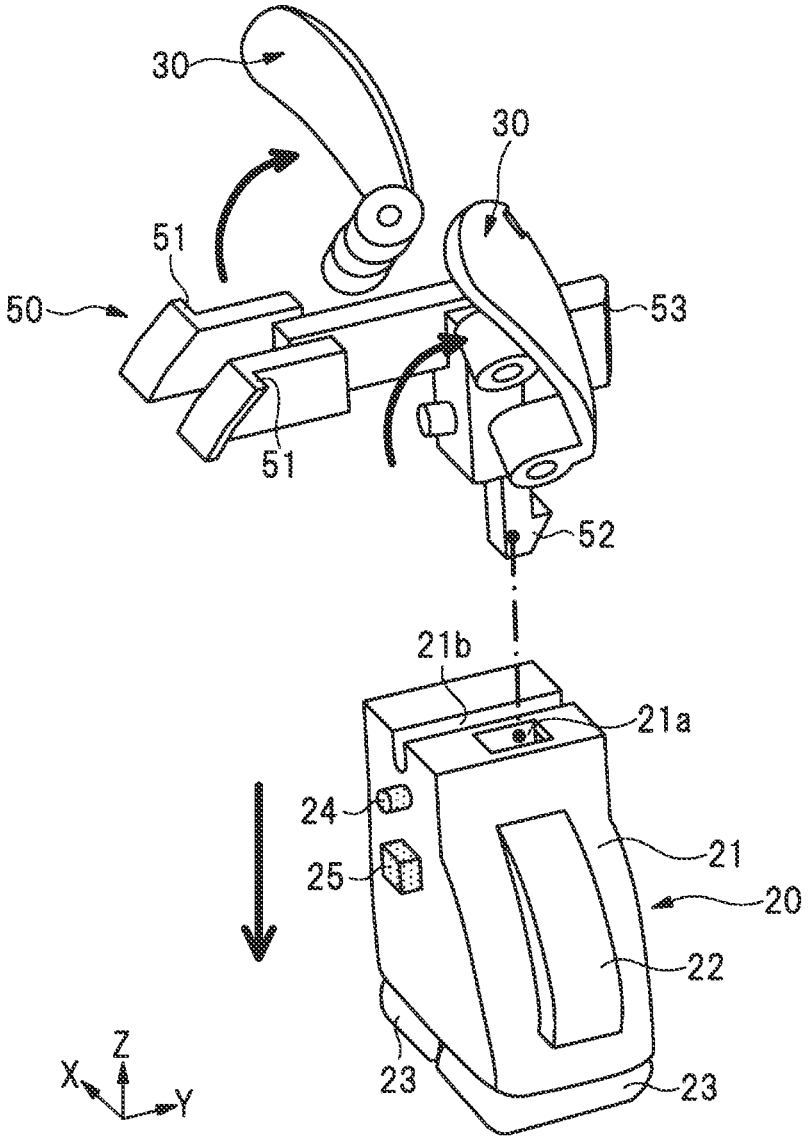
FIG. 5 is a perspective view illustrating a holding mechanism according to the first embodiment.

The holding mechanism 50 can hold the component 20 inside the component 10. As illustrated in FIGS. 1, 4, and 5, the holding mechanism 50 includes, as holding parts, a first holding part 51 and a second holding part 52. The component 30 includes a first held part 31 that is held by the first holding part 51. When the first held part 31, which is a concave portion, is locked and held in a first locking claw at the tip of the first holding part 51, the component 30 is held in a position of covering a part of the outer peripheral surface of the component 10. The component 20 (the main body 21) includes a second held part 21*a* held by the second holding part 52. When the second held part 21*a* is locked and held in a second locking claw at the tip of the second holding part 52, the component 20 is held inside the component 10.

The release mechanism 60 can release the components 20 and 30 from the holding mechanism 50 by vibration. The release mechanism 60 moves at least one of the holding part (the first holding part 51 and the second holding part 52) and the held part (the first held part 31 and the second held part 21*a*) to release the components 30 and 20 from the holding mechanism 50. In the present embodiment, the release mechanism 60 is configured to move the holding part. The component 20 released from the holding mechanism 50 by the release mechanism 60 can be moved from inside the component 10 to the outside of the component 10, and the component 30 released from the holding mechanism 50 by the release mechanism 60 can be rotated relative to the component 10 and moved to a position away from the outer peripheral surface of the component 10. The release mechanism 60 includes a rotating shaft member 61, and the component 20 (the main body 21) includes a groove 21*b*. When the holding mechanism 50 holds the component 20, the rotating shaft member 61 is housed inside the groove 21*b*. Note that the direction of vibration for releasing the components 20 and 30 from the holding mechanism 50 is a direction that is different from the moving direction (Z direction) of the component 20 from the first position to the second position and from the direction in which the component 30 is rotated, such as the X direction, for example. Since the components 20 and 30 are moved in a direction different from the vibration applied for deforming the deformable toy 1, the amusement during deformation is improved. Because deformation is possible by vibration in one direction, the operation to deform is simple and anyone can easily perform the operation to deform.

The holding mechanism 50 will be described with reference to FIG. 5. As illustrated in FIG. 5, the holding mechanism 50 includes the first holding part 51, the second holding part 52, and a release operated part 53. As described above, the second holding part 52 locks and holds the second held part 21*a* of the component 20. The first holding part 51 locks the first held part 31. Note that the component 30 is rotatably connected to the component 10, and the holding mechanism 50 holds the component 30 on the outer peripheral surface of the component 10 such that the component 30 is not rotated on the outer peripheral of the component 10.

When the release operated part 53 is pressed, the second held part 21*a* held by the second holding part 52 and the first held part 31 held by the first holding part 51 are released, the components 20 and 30 are released from the holding mechanism 50, and the components 20 and 30 can be moved. For example, the release operated part 53 is provided at a position facing the surface of a disk 65 (first displacement part) illustrated in FIG. 6. When the disk 65 is rotated, the release operated part 53 comes into contact with an operation protrusion 65*a* provided on the surface of the disk 65, and the first holding part 51 and the second holding part 52 are moved, thereby releasing the second held part 21*a* held by the second holding part 52 and the first held part 31 held by the first holding part 51. That is, the release mechanism 60 releases the components 20 and 30 from the holding mechanism 50 substantially simultaneously. Although not illustrated, the component 10 includes a rotation regulation part that restricts rotation of the component 30 to hold the component 30 at a position apart from the component 10.

Figure 6:
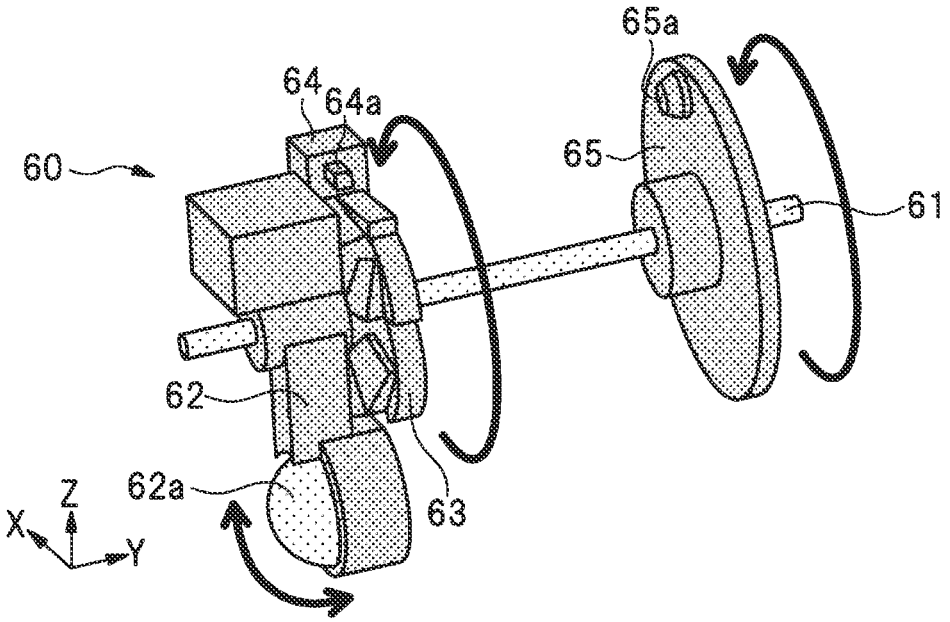
FIG. 6 is a perspective view illustrating a release mechanism according to the first embodiment.

The release mechanism 60 will be described with reference to FIGS. 6 to 8. As illustrated in FIG. 6, the release mechanism 60 includes the rotating shaft member 61, a pendulum 62, a disk 63, a disk control part 64, and the disk 65 (first displacement part). For example, the rotating shaft member 61 is a metal rod and extends in the Y direction.

The pendulum 62 is attached to the rotating shaft member 61. The pendulum 62 includes a weight 62*a* and a protrusion 62*b* provided on the opposite side of the rotating shaft member 61 from the weight 62*a*. The protrusion 62*b* is provided at a position facing the surface of the disk 63.

The pendulum 62 swings back and forth around the rotating shaft member 61 using the rotating shaft member 61 as a support shaft. Note that the rotating shaft member 61 is not rotated by the swinging motion of the pendulum 62. The swing width (swing angle) of the pendulum 62 per reciprocation is 60 degrees, for example.

Both of the disks 63 and 65 have the rotating shaft member 61 as a central axis, and are fixed to the rotating shaft member 61 via a bearing, for example. Therefore, for example, when the disk 63 is rotated, the rotating shaft member 61 and the disk 65 are rotated in conjunction with the rotation of the disk 63. The present embodiment is described by illustrating the configuration in which the holding parts (the first holding part 51 and the second holding part 52) are moved as the disk 65 (displacement part) is displaced (rotated), releasing the components 30 and 20 from the holding mechanism 50, but a configuration is possible, in which the held parts (the first held part 31 and the second held part 21*a*) are moved as the disk 65 is displaced (rotated), releasing the components 30 and 20 from the holding mechanism 50.

Figure 7:
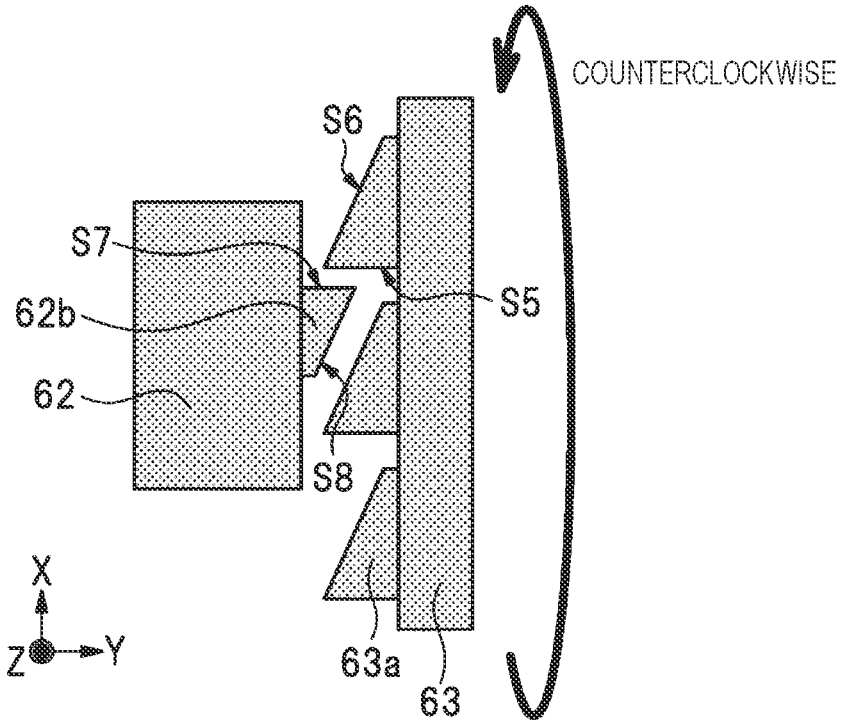
FIG. 7 is a side view illustrating a disk according to the first embodiment.

As illustrated in FIG. 7, the disk 63 is provided with a plurality of protrusions 63*a* on a surface thereof. When vibrations are applied to the deformable toy 1, the pendulum 62 starts swinging motion. By the swinging motion of the pendulum 62, the protrusion 62*b* of the pendulum 62 comes into contact with the plurality of protrusions 63*a*, and the force by the swinging motion is applied to each protrusion 63*a*, thereby rotating the disk 63. The rotating shaft member 61 and the disk 65 are rotated in conjunction with the rotation of the disk 63, and the operation protrusion 65*a* of the disk 65 comes into contact with the release operated part 53 by the rotation of the disk 65.

Here, the pendulum 62 is moved clockwise and counterclockwise within the range of swing width, but in the release mechanism 60 in the first embodiment, the rotating shaft member 61, the disk 63, and the disk 65 are rotated only in one rotation direction (counterclockwise) according to the displacement of the vibration of the pendulum 62. Note that "clockwise" and "counterclockwise" described herein are rotational directions seen from a direction from the disk 63 to the disk 65. Hereinafter, the reason will be described.

Figure 8:
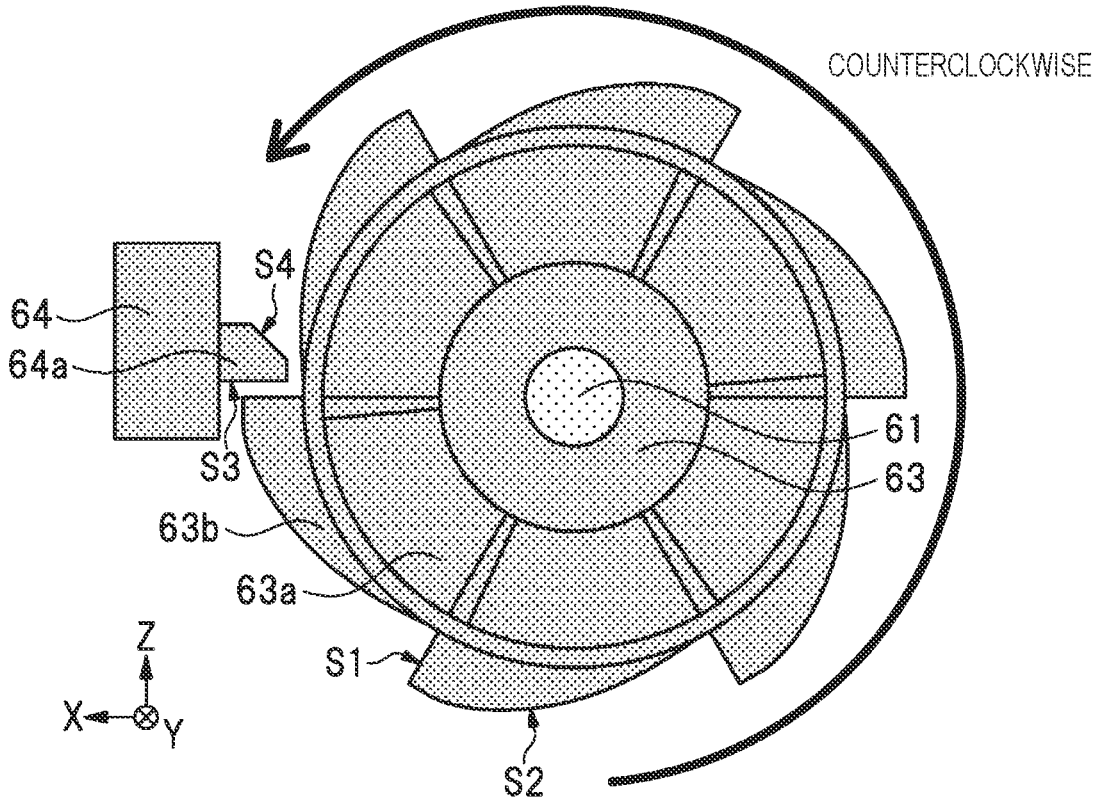
FIG. 8 is a plan view illustrating the disk according to the first embodiment.

As illustrated in FIG. 8, a protrusion 64*a* is provided on the surface of the disk control part 64 to face the outer peripheral surface of the disk 63. A plurality of protrusions 63*b* are provided on the outer peripheral surface of the disk 63.

Each of the plurality of protrusions 63*b* has an abutment surface S1 and an inclined surface S2. The abutment surface S1 is provided at an angle substantially perpendicular to the outer peripheral surface of the disk 63. The inclined surface S2 is inclined with respect to the outer peripheral surface of the disk 63 at an angle smaller than that of the abutment surface S1. The protrusion 64*a* has an abutment surface S3 and an inclined surface S4. The abutment surface S3 is provided at an angle substantially perpendicular to the surface of the disk control part 64. The inclined surface S4 is inclined with respect to the surface of the disk control part 64 at an angle smaller than that of the abutment surface S3.

When the disk 63 is rotated, the abutment surface S3 comes into contact with the abutment surface S1 in the clockwise direction, and the inclined surface S4 comes into contact with the inclined surface S2 in the counterclockwise direction. When the abutment surface S3 contacts the abutment surface S1, the rotation of the disk 63 is stopped. That is, since the disk 63 is not rotated in the clockwise direction, the rotating shaft member 61 and the disk 65 are also not rotated in the clockwise direction.

Although not illustrated, an elastic body such as a spring attached to the protrusion 64*a* is provided inside the disk control part 64. Therefore, when the inclined surface S4 contacts the inclined surface S2, the protrusion 64*a* is pushed down into the disk control part 64. Therefore, the disk 63 is rotated in the counterclockwise direction, and the rotating shaft member 61 and the disk 65 are also rotated in the counterclockwise direction.

To promote the rotation of the disk 63 only in the counterclockwise direction, the plurality of protrusions 63*a* on the surface of the disk 63 and the protrusion 62*b* on the surface of the pendulum 62 may also have an abutment surface and an inclined surface.

As illustrated in FIG. 7, each of the plurality of protrusions 63*a* has an abutment surface S5 and an inclined surface S6. The abutment surface S5 is provided at an angle substantially perpendicular to the surface of the disk 63. The inclined surface S6 is inclined with respect to the surface of the disk 63 at an angle smaller than that of the abutment surface S5. The protrusion 62*b* has an abutment surface S7 and an inclined surface S8. The abutment surface S7 is provided at an angle substantially perpendicular to the surface of the pendulum 62. The inclined surface S8 is inclined with respect to the surface of the pendulum 62 at a smaller angle than that of the abutment surface S7.

When the disk 63 is rotated, the abutment surface S7 comes into contact with the abutment surface S5 in the counterclockwise direction, and the inclined surface S8 comes into contact with the inclined surface S6 in the clockwise direction. When the abutment surface S7 contacts the abutment surface S5, rotation of the disk 63 is promoted. That is, the disk 63 is rotated in the counterclockwise direction, and the rotating shaft member 61 and the disk 65 are also rotated in the counterclockwise direction.

Although not illustrated, an elastic body such as a spring attached to the protrusion 62*b* is provided inside the pendulum 62. Therefore, when the inclined surface S8 contacts the inclined surface S6, the protrusion 62*b* is pushed down into the pendulum 62. Therefore, since the disk 63 is not substantially rotated in the clockwise direction, the rotating shaft member 61 and the disk 65 are also not substantially rotated in the clockwise direction.

As described above, according to the first embodiment, the swinging motion of the pendulum 62 is used to release the components 20 and 30, and the rotating shaft member 61, the disk 63, and the disk 65 may be rotated only counterclockwise. Since the swing width of the pendulum 62 per reciprocation is set to 60 degrees, the operation protrusion 65*a* of the disk 65 comes into contact with the release operated part 53 of the holding mechanism 50 every six reciprocation of the pendulum 62. That is, the release mechanism 60 releases the components 20 and 30 from the holding mechanism 50 in response to the disk 65 (displacement part) being displaced a plurality of times.

Figure 9:
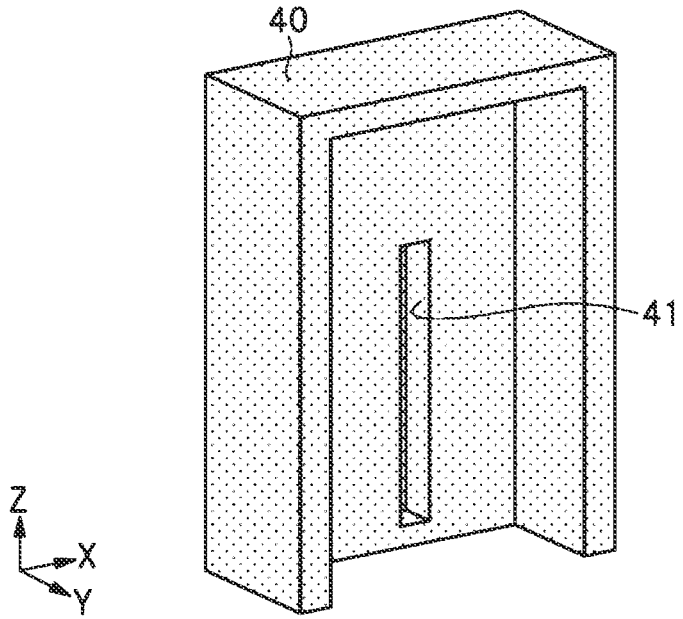
FIG. 9 is a cross-sectional perspective view illustrating a storage part according to the first embodiment.

The mechanism by which the component 20 can be moved inside the storage part 40 will be described below with reference to FIG. 9. FIG. 9 illustrates the inside of the storage part 40. As illustrated in FIG. 9, the storage part 40 is provided with a guide part 41. The guide part 41 is provided along a direction in which the component 20 is moved from the inside of the storage part 40 (the inside of the component 10) to the outside of the storage part 40 (the outside of the component 10), that is, along the Z direction. In other words, the guide part 41 is provided to guide the component 20 to move toward the opening 11.

As illustrated in FIG. 5, the component 20 includes a guided part 24 that is guided by the guide part 41. By guiding the guided part 24 with the guide part 41, the moving direction of the component 20 may be fixed in the Z direction.

Although the guide part 41 extends to near the lower end of the storage part 40 in the Z direction, the guide part 41 is not opened from the lower end of the storage part 40. Therefore, when the component 20 is moved, the component 20 may be prevented from being completely detached from the storage part 40.

Figure 10:
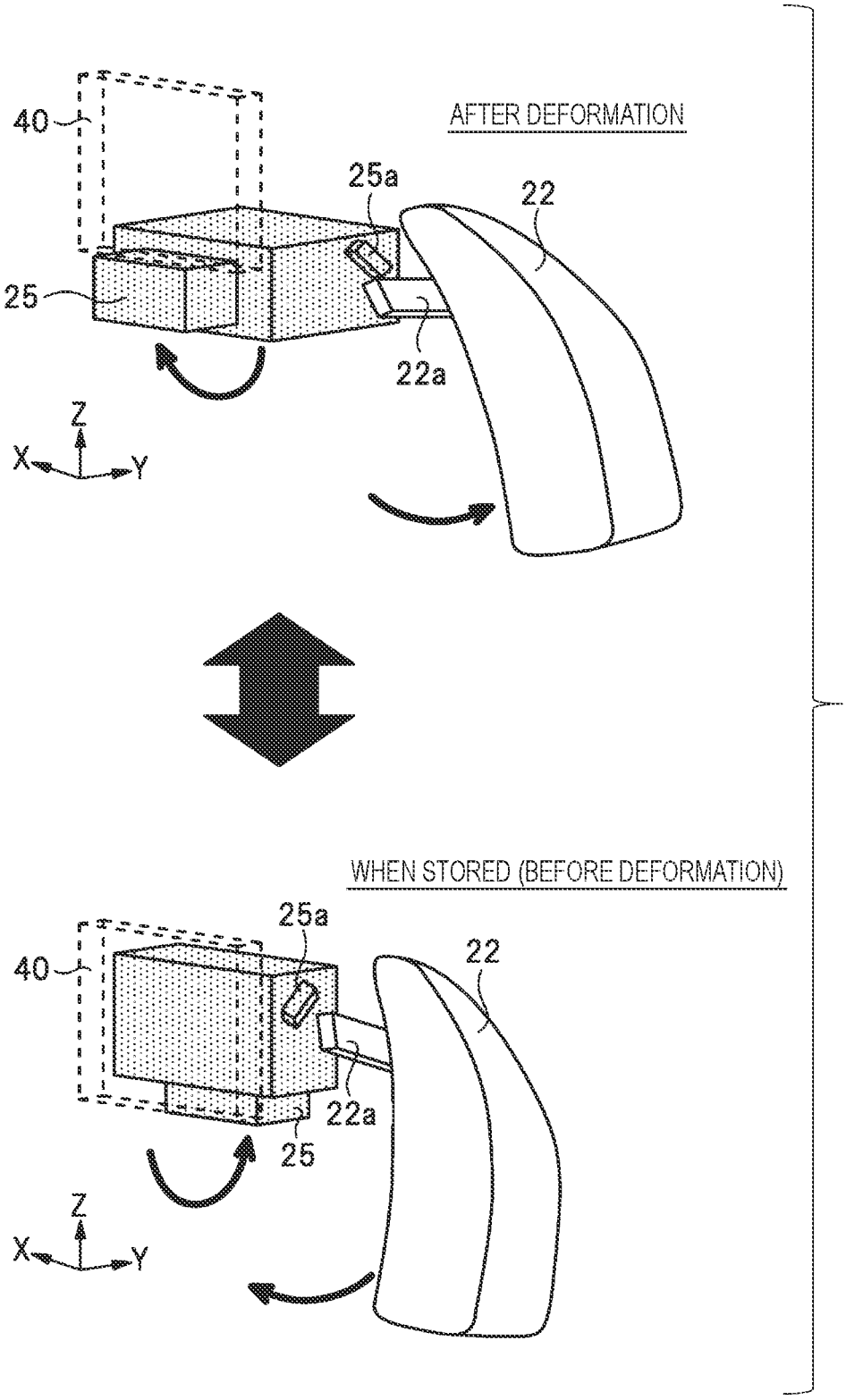
FIG. 10 is a perspective view illustrating a regulation part and a displacement part according to the first embodiment.

A mechanism by which the component 20 does not automatically return to the inside of the component 10 when the component 20 is moved to the outside of the component 10 will be described below using FIG. 10. FIG. 10 illustrates a regulation part 25 and the displacement part 22 of the component 20, and also illustrates a part of the storage part 40 by a broken line.

As illustrated in FIG. 2, and the like, when the component 20 is positioned outside the component 10 (after deformation by vibration), the regulation part 25 (second displacement part) protrudes from the main body 21. That is, the regulation part 25 is displaced from a position before deformation by vibration to a position after deformation by vibration. Here, as illustrated in FIG. 10, movement of the component 20 is restricted by the displaced regulation part 25 coming into contact with the storage part 40 included in the first component. That is, the component 20 that is moved outside the component 10 in response to the deformation is restricted from being moved into the component 10. Therefore, when the placement part 23 is placed on a placement surface after the deformation by vibration as illustrated in FIG. 1 or 2, the deformable toy 1 can stand by itself on the placement surface.

The regulation part 25 includes a protrusion 25*a* inside the main body 21. A protrusion 22*a* is connected to the displacement part 22 inside the main body 21. As the component 20 is moved in a direction of advancing to the outside of the component 10, the protrusion 25*a* pushes the protrusion 22*a* by the weight of the component 20. Then, the displacement part 22 is displaced in a direction away from the main body 21. That is, the doll is in the form with its upper limbs spread out. In the doll form after deformation, the width of the component 20 positioned outside the component 10 in the direction in which the displacement part 22 is displaced is greater than the width of the opening 11 in the direction in which the displacement part 22 is displaced. If there is no displacement part 22, only the main body 21 smaller than the width of the opening 11 can be moved from the inside of the component 10 to the outside of the component 10, but because the displacement part 22 that is displaced in response to movement outside the component 10 is provided, the width of the component 20 after deformation is greater than the width of the opening portion 11, which can further improve the amusement from the deformation.

A mechanism for returning the deformable toy 1 after deformation by vibration to the form before deformation by vibration will be described.

When the user displaces the displacement part 22 to be closer to the main body 21, the protrusion 22*a* pushes the protrusion 25*a*. In conjunction with the displacement of the displacement part 22, the regulation part 25 is stored inside the component 20 (inside the main body 21). As a result, the component 20 moved outside the component 10 is displaced to a position where the component 20 can be moved from the outside of the component 10 (outside the storage part 40) to the inside of the component 10 (inside the storage part 40).

Then, the main body 21 and the displacement part 22 are stored inside the storage part 40. By pushing the component 20 into the storage part 40, the second held part 21*a* of the component 20 is held by the second holding part 52 of the holding mechanism 50. As a result, the deformable toy 1 is returned to the form before the deformation by vibration.

Regarding the component 30, the user moves the component 30 to the position before the deformation where the component 30 covers a part of the outer peripheral surface of the component 10, and the first held part 31 of the component 30 is locked and held by the first holding part 51 of the holding mechanism 50 such that the deformable toy 1 returns to the form before the deformation by vibration.

Although the present invention has been specifically described above based on the embodiments, the present invention is not limited to the embodiments described above and can be variously modified without departing from the gist thereof.

The embodiments described above will be summarized below.

(1) A deformable toy deformable from a first form to a second form different from the first form, the deformable toy including a first component, a second component, a holding mechanism provided in the first component and capable of holding the second component in a first position, and a release mechanism provided in the first component and capable of releasing the second component from the holding mechanism by vibration, in which the second component released from the holding mechanism by the release mechanism is moved from the first position to a second position different from the first position to deform the deformable toy from the first form to the second form.

(2) The deformable toy according to (1), in which the holding mechanism includes a holding part, the second component includes a held part held by the holding part, and the release mechanism moves at least one of the holding part and the held part to release the second component from the holding mechanism.

(3) The deformable toy according to (2), in which the release mechanism includes a first displacement part that is configured to be displaced by vibration, and the first displacement part is displaced to move at least one of the holding part and the held part.

(4) The deformable toy according to (3), in which the release mechanism releases the second component from the holding mechanism in response to displacing the first displacement part a plurality of times.

(5) The deformable toy according to (3), in which the release mechanism includes a pendulum that vibrates in response to vibration applied to the first component, and rotationally displaces the first displacement part in response to the displacement of the vibration of the pendulum.

(6) The deformable toy according to (5), in which the release mechanism rotationally displaces the first displacement part in only one direction.

(7) The deformable toy according to any one of (1) to (6), in which a plurality of the second components are provided at different positions, and the plurality of second components are held in the first component by the holding mechanism, and the release mechanism releases the plurality of the second components from the holding mechanism substantially simultaneously.

(8) The deformable toy according to (7), in which the plurality of the second components are provided on both of one side of the first component and another side opposite to the one side of the first component, respectively.

(9) The deformable toy according to (1), in which at least a part of the second components is disposed inside the first component, an opening is formed in the first component such that an inside of the first component and an outside of the first component communicate, and at least a part of the second components disposed inside the first component is moved from the inside of the first component to the outside of the first component through the opening in response to the second component being released from the holding mechanism by the release mechanism.

(10) The deformable toy according to (9), in which a guide part is provided inside the first component to guide the second component to be moved toward the opening, and the second component includes a guided part guided by the guide part.

(11) The deformable toy according to any one of (9) or (10), in which a direction of vibration for releasing the second component from the holding mechanism is a direction different from a direction of movement of the second component from the first position to the second position.

(12) The deformable toy according to any one of (9) or (11), further including a second displacement part that is displaced in response to movement of the second component from the first position to the second position, in which, the second displacement part restricts the second component, which has been moved in response to the deformation, from being moved to the inside of the first component, by coming into contact with a part of the first component at a position after the deformation to the second form.

(13) The deformable toy according to (12), in which the second component further includes a main body and a third displacement part connected to be capable of being displaced with respect to the main body, and the third displacement part may be displaced in a direction away from the main body in response to the main body moving to the outside of the first component.

(14) The deformable toy according to (13), in which, in the second form, a width of the second component positioned outside the first component in a direction in which the third displacement part is displaced is greater than a width of the opening in the direction in which the third displacement part is displaced.

(15) The deformable toy according to (13), in which the second displacement part is displaced to a position where the second component, which has been moved to the outside of the first component, is configured to be moved into the first component in response to the third displacement part being displaced to be closer to the main body.

(16) The deformable toy according to (15), in which the first component forms a head of a doll, the main body forms a body of the doll, the third displacement part forms upper limbs of the doll, the second component further includes a placement part that is connected to the main body and forms lower limbs of the doll, and when the placement part is placed on a placement surface, the doll can stand by itself on the placement surface.

(17) The deformable toy according to (16), in which, when the second component is held at the first position, the placement part is disposed at a position of the opening.

(18) The deformable toy according to any one of (1) to (17), in which the first position is a position that covers a part of an outer peripheral surface of the first component, and the part of the outer peripheral surface of the first component is exposed when the second component is moved from the first position to the second position.

(19) The deformable toy according to (18), in which the second component is rotatably connected to the first component, and the holding mechanism holds the second component so that the second component is not rotated around an outer periphery of the first component.

(20) The deformable toy according to (19), in which the first component includes a rotation regulation part that restricts rotation of the second component to hold the second component at a position apart from the first component.

The invention claimed is:

1. A deformable toy deformable from a first form to a second form different from the first form, the deformable toy comprising:

a first component;

a second component;

a holding mechanism provided in the first component and capable of holding the second component in a first position; and a release mechanism provided in the first component and capable of releasing the second component from the holding mechanism by vibration, wherein the second component released from the holding mechanism by the release mechanism is moved from the first position to a second position different from the first position to deform the deformable toy from the first form to the second form, the holding mechanism includes a holding part, the second component includes a held part held by the holding part, the release mechanism moves at least one of the holding part and the held part to release the second component from the holding mechanism, the release mechanism includes a first displacement part that is configured to be displaced by vibration, the first displacement part is displaced to move at least one of the holding part and the held part, and the release mechanism releases the second component from the holding mechanism in response to displacing the first displacement part a plurality of times.

2. The deformable toy according to claim 1, wherein a plurality of the second components are provided at different positions, the plurality of the second components are held in the first component by the holding mechanism, and the release mechanism releases the plurality of the second components from the holding mechanism substantially simultaneously.

3. The deformable toy according to claim 2, wherein the plurality of the second components are provided on both of one side of the first component and another side opposite to the one side of the first component, respectively.

4. The deformable toy according to claim 1, wherein the first position is a position that covers a part of an outer peripheral surface of the first component, and the part of the outer peripheral surface of the first component is exposed when the second component is moved from the first position to the second position.

5. The deformable toy according to claim 4, wherein the second component is rotatably connected to the first component, and the holding mechanism holds the second component so that the second component is not rotated around an outer periphery of the first component.

6. The deformable toy according to claim 5, wherein the first component includes a rotation regulation part that restricts rotation of the second component to hold the second component at a position apart from the first component.

7. A deformable toy deformable from a first form to a second form different from the first form, the deformable toy comprising:

a first component;

a second component;

a holding mechanism provided in the first component and capable of holding the second component in a first position; and a release mechanism provided in the first component and capable of releasing the second component from the holding mechanism by vibration, wherein the second component released from the holding mechanism by the release mechanism is moved from the first position to a second position different from the first position to deform the deformable toy from the first form to the second form, the holding mechanism includes a holding part, the second component includes a held part held by the holding part, the release mechanism moves at least one of the holding part and the held part to release the second component from the holding mechanism, the release mechanism includes a first displacement part that is configured to be displaced by vibration, the first displacement part is displaced to move at least one of the holding part and the held part, the release mechanism includes a pendulum that vibrates in response to vibration applied to the first component, and rotationally displaces the first displacement part in response to the displacement of the vibration of the pendulum, and the release mechanism rotationally displaces the first displacement part in only one direction.

8. A deformable toy deformable from a first form to a second form different from the first form, the deformable toy comprising:

a first component;

a second component;

a holding mechanism provided in the first component and capable of holding the second component in a first position; and a release mechanism provided in the first component and capable of releasing the second component from the holding mechanism by vibration, wherein the second component released from the holding mechanism by the release mechanism is moved from the first position to a second position different from the first position to deform the deformable toy from the first form to the second form, at least a part of the second components is disposed inside the first component, an opening is formed in the first component such that an inside of the first component and an outside of the first component communicate, at least a part of the second components disposed inside the first component is moved from the inside of the first component to the outside of the first component through the opening in response to the second component being released from the holding mechanism by the release mechanism, and the deformable toy further comprises a second displacement part that is displaced in response to movement of the second component from the first position to the second position, wherein the second displacement part restricts the second component, which has been moved in response to the deformation, from being moved to the inside of the first component, by coming into contact with a part of the first component at a position after the deformation to the second form.

9. The deformable toy according to claim 8, wherein a guide part is provided inside the first component to guide the second component to be moved toward the opening, and the second component includes a guided part guided by the guide part.

10. The deformable toy according to claim 8, wherein a direction of vibration for releasing the second component from the holding mechanism is a direction different from a direction of movement of the second component from the first position to the second position.

11. The deformable toy according to claim 8, wherein the second component further includes a main body and a third displacement part connected to be capable of being displaced with respect to the main body, and the third displacement part is displaced in a direction away from the main body in response to the main body moving to the outside of the first component.

12. The deformable toy according to claim 11, wherein, in the second form, a width of the second component positioned outside the first component in a direction in which the third displacement part is displaced is greater than a width of the opening in the direction in which the third displacement part is displaced.

13. The deformable toy according to claim 11, wherein the second displacement part is displaced to a position where the second component, which has been moved to the outside of the first component, is configured to be moved into the first component in response to the third displacement part being displaced to be closer to the main body.

14. The deformable toy according to claim 13, wherein the first component forms a head of a doll, the main body forms a body of the doll, the third displacement part forms upper limbs of the doll, the second component further includes a placement part that is connected to the main body and forms lower limbs of the doll, and when the placement part is placed on a placement surface, the doll can stand by itself on the placement surface.

15. The deformable toy according to claim 14, wherein, when the second component is held in the first position, the placement part is disposed at a position of the opening.

* * * * *